United States Patent [19]

Ojala

[11] Patent Number: 5,010,856

[45] Date of Patent: Apr. 30, 1991

[54] ENGINE FINGER FOLLOWER TYPE ROCKER ARM ASSEMBLY

[75] Inventor: William K. Ojala, Birmingham, Mich.

[73] Assignee: Ford Motor Company, Dearborn, Mich.

[21] Appl. No.: 597,460

[22] Filed: Oct. 15, 1990

[51] Int. Cl.[5] ..... F01M 9/10; F01L 1/18

[52] U.S. Cl. ..... 123/90.36; 123/90.44; 123/90.41; 74/519; 74/559

[58] Field of Search ..... 123/90.33, 90.36, 90.27, 123/90.39, 90.41, 90.42, 90.44, 90.45, 90.47; 74/519, 559

[56] References Cited

U.S. PATENT DOCUMENTS

| | | | |
|---|---|---|---|
| 1,210,871 | 1/1917 | Suffa | 123/90.35 |
| 1,363,398 | 12/1920 | Davids | 123/90.52 |
| 1,409,878 | 3/1922 | Mainland | 384/28 |
| 2,081,390 | 5/1937 | Trapp | 74/569 |
| 2,151,832 | 3/1939 | Bugatti | 74/569 |
| 2,322,173 | 6/1943 | Spencer | 123/90.36 |
| 2,385,309 | 9/1945 | Spencer | 74/519 |
| 2,572,968 | 10/1951 | Bachle | 123/90.33 |
| 2,733,619 | 2/1956 | Smith | 74/569 |
| 3,108,580 | 10/1963 | Crane, Jr. | 123/90.5 |
| 3,137,283 | 6/1964 | Sampietro | 123/90.43 |
| 3,977,370 | 8/1976 | Humphreys | 123/90.5 |
| 4,204,814 | 3/1978 | Matzen | 74/569 |
| 4,406,257 | 9/1983 | Keske et al. | 123/90.48 |
| 4,614,171 | 9/1986 | Malhotra | 123/90.44 |
| 4,796,483 | 1/1989 | Patel et al. | 123/90.44 |
| 4,825,717 | 5/1989 | Mills | 123/90.44 |
| 4,909,197 | 3/1990 | Perr | 123/90.39 |

FOREIGN PATENT DOCUMENTS

| | | | |
|---|---|---|---|
| 172409 | 10/1983 | Japan | 123/90.33 |

*Primary Examiner*—David A. Okonsky
*Assistant Examiner*—Weilun Lo
*Attorney, Agent, or Firm*—Jerome R. Drouillard; Clifford L. Sadler

[57] ABSTRACT

A valve train for an overhead camshaft type engine includes a finger follower lever type rocker arm assembly. The lever is of lightweight stamped construction containing a pocket or recess in which is received a precision molded plastic bearing cup. The cup has a smoothly polished bearing surface for slidably receiving an axleless roller that is contained laterally within the insert and is rotated by the engine driven cam located above the roller for pivotally moving the lever to actuate the engine valves. The inclusion of the pocket in the lever assures lubrication of the parts at all times since it will collect and retain lubricant or engine oil during engine operation so that even during a lengthy shutdown, upon restart, the elements will be fully lubricated.

9 Claims, 1 Drawing Sheet

ENGINE FINGER FOLLOWER TYPE ROCKER ARM ASSEMBLY

FIELD OF THE INVENTION

This invention relates in general to an automotive type engine valve train. More particularly, it relates to a valve train of the overhead cam, finger follower lever rocker arm type for reducing weight and friction, the rocker arm assembly including a roller nested within a low friction bearing insert in the lever.

BACKGROUND OF THE INVENTION

To improve automotive engine fuel economy, a current objective in the design of valve trains is weight and friction reduction. This has been accomplished in the past, for example, by the use of stamped steel rocker arms instead of heavier forged or cast arms, and the use of roller bearings between the engine cam and rocker arm surface for reducing friction. A switch to finger follower lever type rocker arms also has reduced weight and complexity and friction; but, in general, these latter type constructions generally employ only a cylindrical surface or an axle type roller rotatable on needle bearings or bronze bushings.

For example, U.S. Pat. No. 2,081,390 to Trapp, U.S. Pat. No. 3,977,370 to Humphreys, U.S. Pat. No. 3,137,283 to Sampietro, and U.S. Pat. No. 3,108,580 to Crane, Jr., all show the use of rollers in cam followers for reducing friction and weight between the parts. However, it will be noted then in each of the instances, the rollers all have axles, generally with roller bearings or other suitable low friction parts. This not only complicates the construction but increases the weight and cost of manufacture. Furthermore, in most instances, the rollers are located above the cam and are not self-lubricating, i.e., the recesses in which they are located will not retain oil or other lubricant when the engine is shut down.

U.S. Pat. No. 1,363,398 to Davids, U.S. Pat. No. 1,210,871 to Suffa, and U.S. Pat. No. 1,409,878 to Mainland, are other examples of push rod type valve lifters in which a ball or roller is received in a cage but is movable only in a vertical direction and is retained in a housing that is difficult to machine and generally without consideration of weight reduction.

U.S. Pat. No. 2,151,832 to Bugatti shows a finger follower type rocker arm assembly in which a ball is used between the cam and tappet. However, in this case, a number of balls/rollers are required for rolling against their bearing surfaces, and a retainer is additionally required to maintain the intermediate roller in place. The size and weight of this construction would be excessive, and the roller does not slide in the lever bearing surface but rolls against the other rollers. Also, the cam being located below the lever prevents retention of lubricant for the rolling bearing surfaces upon engine shutdown.

U.S. Pat. No. 4,204,814 to Matzen also shows a construction in which the roller performs a dual function of being an axle and a camshaft follower. It is contained within a two-piece roller shaft 18 which, from a construction standpoint, provides alignment problems for the split bearing surface. Furthermore, while a gap 14 is provided for the introduction of lubricant or oil to the roller, upon engine shutdown, the lubricant will drain out and provide a dry start for the next cycle.

U.S. Pat. No. 4,406,257 to Keske et al. shows a roller follower in which a roller 30 has in effect a pair of laterally extending axles 34, 36 supported upon bearing surfaces 26, 28, each part of a two-piece support, the central portion of the roller being interdigited with the support. The cam follower surface, therefore, is separate from the rolling surface. The construction as disclosed is difficult to machine and assemble the bearing surfaces 26, 28 with precision in order to avoid edge riding of the bearing. Neither friction nor weight appears to be minimized with such construction.

SUMMARY OF THE INVENTION

The present invention relates to a finger follower lever type assembly in which the lever includes a recess in which is received a precision molded bearing insert. The insert has a configuration mating with the outer surface of a roller that is received within the bearing insert and in turn is engaged by the cam of an overhead camshaft type valve train. The use of the insert enables the use of a stamped type finger follower with ordinary machining. This allows weight reduction and eliminates or minimizes the use of precision machining and polishing equipment for the manufacture of the follower lever itself. The insert in this case could be molded from a plastic with a high precision surface permitting sliding of the roller with a minimum of friction as it is rotated by the engine driven cam. The use of plastic or similar material also provides increased weight reduction as compared to conventional constructions. Furthermore, the ability of the roller in this case to run on the polished surface of the insert eliminates the need for an axle or roller with needle bearings, such as was described above in connection with the prior art references. The roller can be hollowed out, made of various lightweight materials, and of various configurations for weight reduction. Also, the bathtub-shaped pocket receiving the roller and insert collects and retains lubricant or oil during engine operation, when the latter is sprayed on various parts of the valve train, so that when the engine is shut down, lubricant will still be available upon engine start-up.

It is, therefore, a primary object of the invention to provide a valve train of the finger follower lever type with an assembly in which an axleless roller is received within the lever for sliding movement against a polished bearing surface for both weight reduction and minimization of friction between the parts.

It is a further object of the invention to provide the lever with a precision molded bearing insert having a surface mating with the outer annular surface of the roller with which it is engaged and which also engages the cam of an overhead camshaft type engine valve train.

BRIEF DESCRIPTION OF THE DRAWINGS

Other objects, features and advantages of the invention will become more apparent upon reference to the succeeding, detailed description thereof, and to the drawings illustrating the preferred embodiment thereof; wherein, FIG. 1 schematically illustrates a cross-sectional view of a portion of an engine valve train embodying the invention.

DETAILED DESCRIPTION OF THE PREFERRED EMBODIMENT

Figure 1:
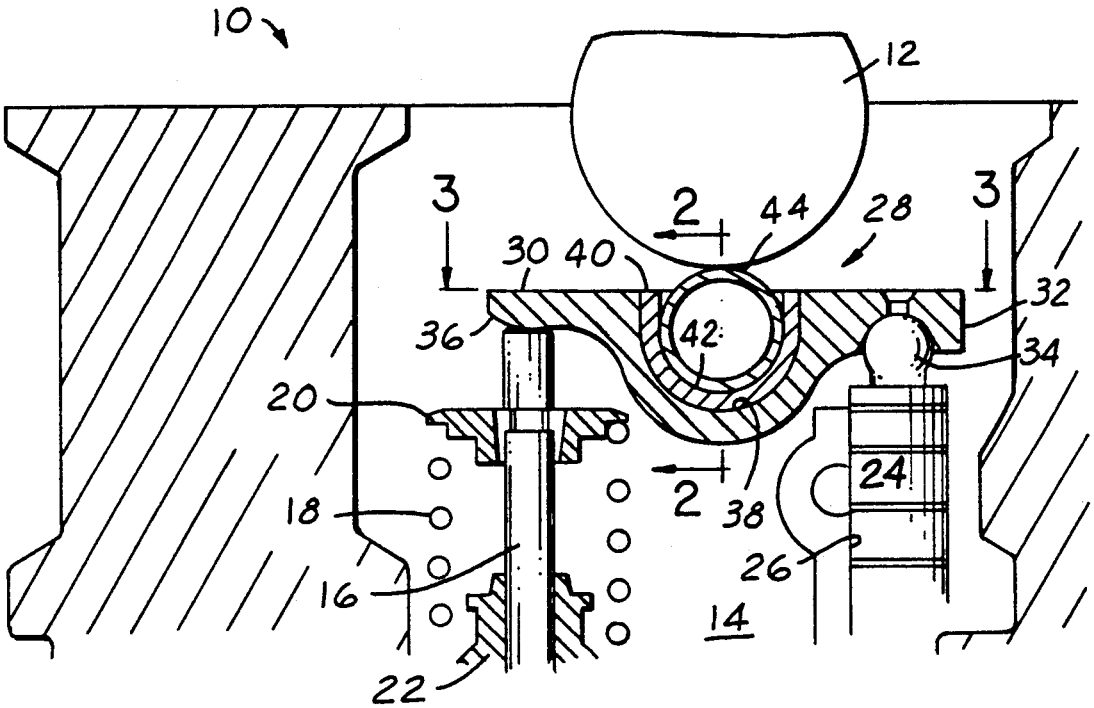

FIG. 1 illustrates schematically a portion 10 of an automotive type engine. In this case, it includes a valve train of the overhead camshaft type in which a camshaft (not shown) rotates a cam 12 fixed thereon. The engine contains a cylinder head 14 in which is mounted for reciprocation a valve stem 16 attached at its lower end to a valve (not shown). The stem is surrounded by the usual return spring 18 and a valve keeper 20, and slides in a sleeve 22 for a reciprocating motion for opening and closing the valve in a known manner. The cylinder head also contains a tappet 24 movable in a pocket 26 in the head, and acting as a fulcrum for the pivotal movement of a finger follower lever type rocker arm 28.

Figure 2:
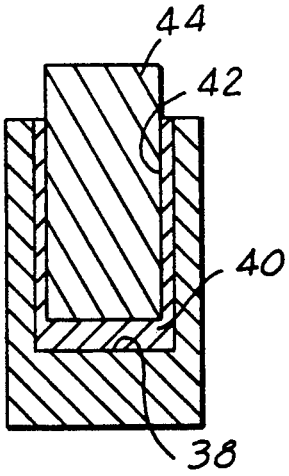
FIGS. 2 and 3 are cross-sectional views taken on planes indicated by and viewed in the direction of the arrows 2—2 and 3—3 of FIG. 1.
Figure 3:
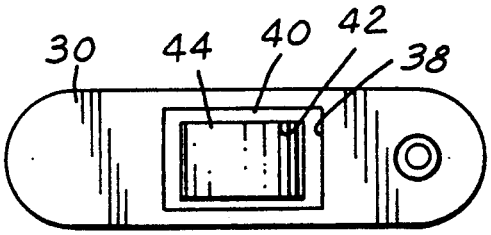

More specifically, the lever or rocker arm 28 has an elongated body 30 with a cup-shaped fulcrum end 32. The latter receives the spherical end 34 of the tappet body. The other end of lever 28 is formed as shown with a valve actuating portion 36 engagable with the upper end of the stem 16 for reciprocating the same. The central portion of lever 28 is stamped with a recess or hollow pocket (FIGS. 2 and 3) 38 that need not be precision machined or polished. The pocket or recess is essentially of a bathtub shaped configuration opening upwardly and receives therein a one-piece precision molded plastic bearing cup 40 that has a precision molded or polished surface 42. On the surface is slidably supported a hollow axleless roller follower 44. The outside diameter of the roller slides on the smooth bearing surface of the insert and in turn is rolled by engagement above with the cam 12 during pivotal movement of the lever. The bathtub shape also retains the roller follower against lateral movement.

It will be seen in this case that with the camshaft located above the finger follower lever, and the roller being contained in the insert in the pocket of the lever, that during operation of the engine, when engine oil or lubricant is sprayed thoroughly and continuously in the area around the valve train, lubricant will collect in the pocket and be retained therein so that during a restart after engine shutdown the parts will be lubricated. Furthermore, the benefits of using the insert is that it provides a wide range of material selection to ensure bearing compatibility and long roller life. Some of these materials would be, for example, high molecular weight plastics that are especially engineered for dry or lubricated operation. These materials would not gall when run against metal and would burnish the high spots during break-in without damaging the roller. The use of powdered metal bearing cups would be another material choice, and bearing materials such as bronze could be used with graphite, lead or other materials known to those skilled in the art and suggested by this disclosure.

The bearing insert cup 40 in this case being of a molded composite or powdered metal could easily be configured to prevent rotation about the tappet axis merely by molding a tab or tabs that extend beyond the tappet outside diameter.

The use of a plastic insert also has the added advantage of reducing valve train inertia. This can be a tradeoff for better performance and/or fuel economy, reduced NVH and reduced component stress and wear. The use of ceramic rollers also has the ability to further reduce valve train weight for even greater improvement, since they could be as much as 40% lighter than the use of metal rollers. Plastic is a lubricating type material. Therefore, the use of a plastic insert can be self-lubricating. The plastic, per se, is a slick material and lubricating material can be embedded in it, or together alloyed. Once the engine began operation and oil slung in the area, then it can provide self-lubrication. Those skilled in the art will appreciate in view of this disclosure that insert 40 could be modified to include retention means, for example in the form of tabs molded integrally with the insert, to prevent the roller from becoming separated from the follower assembly prior to installation in an engine.

From the above, it will be seen that the invention provides a low weight and reduced friction type valve train by the use of a precision molded insert operable in a pocket provided in a finger follower lever type rocker arm, the insert having a bearing surface that is extremely smooth for a sliding engagement with a roller follower of light weight movable by a cam of an overhead camshaft type engine construction. Such a construction provides an easy assembly of the parts, and with continuous lubrication because of the bathtub-shaped reservoir assuring that the bearing surfaces always contain lubricant or oil, even after a lengthy shutdown. Furthermore, the construction assures the pivotal movement of the finger follower lever with a minimum of friction by the use of low weight elements.

While the invention has been shown and described in its preferred embodiment, it will be clear to those skilled in the arts to which it pertains, that many changes and modifications may be made thereto without departing from the scope of the invention.

I claim:

1. A reduced friction finger follower type rocker arm assembly for an overhead camshaft type engine including a one-piece pivotally movable finger follower type lever having a fulcrum at one end and engaging an engine valve stem at its opposite end for reciprocation thereof, the lever having a recess therein opening upwardly and containing an axleless roller bearing therein against lateral movement and an engine rotated cam located above the roller and contiguous thereto for rotating the roller in the lever, the recess including a smoothly formed one-piece bearing insert in the lever upon which the roller slides during rotation by the cam for reducing friction between the parts, the recess retaining engine lubricant admitted thereto during operation of the engine for further reducing friction between the parts and for a lubricated restart after engine shutdown.

2. An assembly as in claim 1, wherein the recess has an essentially bathtub pocket configuration which receives said insert with a precision molded low friction bearing surface against which the roller is supported in a low friction sliding manner.

3. An assembly as in claim 1, wherein the recess is pocket-shaped to conform to the shape of the roller, and receives therein said one-piece bearing insert of precision molded configuration to mate with the surface of the roller for reducing friction.

4. An assembly as in claim 1, wherein the recess in the lever is defined by a pocket, the pocket containing said one-piece bearing insert of a configuration precision molded to mate with the surface pocket of the roller to thereby eliminate the necessity of a precision molded surface in the lever.

5. A rocker arm assembly for an overhead camshaft engine including a pivotally movable finger follower type rocker arm lever engaging a fulcrum at one end and a reciprocal engine valve stem at the other end for actuation thereof, the lever having a pocket therein opening upwardly and containing a one-piece plastic bearing cup of precision molded configuration with a smooth low friction bearing surface, the cup bearing surface receiving and supporting thereon above the cup a roller for a sliding movement therein, and an engine cam above the roller engaging and rotating the roller and simultaneously forcibly moving the lever in a pivotal manner to actuate the valve stem, the cup retaining any engine lubricant admitted thereto during engine operation for reducing friction between the cup bearing surface and roller.

6. An assembly as in claim 5, wherein the roller is hollow and axleless.

7. An assembly as in claim 5, wherein the cup is of a self-lubricating construction.

8. An assembly as in claim 5, wherein the cup is of a high molecular weight plastic accommodating dry and lubricated operations.

9. An assembly as in claim 5, wherein the cup is constructed of powdered metal for greater compatibility with the materials of the roller and lever.

* * * * *